US006377291B2

(12) United States Patent
Andoh et al.

(10) Patent No.: US 6,377,291 B2
(45) Date of Patent: Apr. 23, 2002

(54) IMAGE FORMING APPARATUS AND METHOD, AND IMAGE-APPLIED ARTICLE

(75) Inventors: Tomio Andoh; Tomoyuki Marugame; Nobuaki Honma, all of Tokyo (JP)

(73) Assignee: Toppan Printing Co., Ltd., Tokyo (JP)

( * ) Notice: Subject to any disclaimer, the term of this patent is extended or adjusted under 35 U.S.C. 154(b) by 0 days.

(21) Appl. No.: 09/785,209

(22) Filed: Feb. 20, 2001

Related U.S. Application Data

(63) Continuation of application No. PCT/JP99/04605, filed on Aug. 26, 1999.

(30) Foreign Application Priority Data

Aug. 26, 1998 (JP) ..... 10-239950

(51) Int. Cl.[7] ..... B41J 21/325; B41J 2/36
(52) U.S. Cl. ..... 347/213; 347/176
(58) Field of Search ..... 347/206, 213, 347/171, 172, 174, 176, 215, 221; 400/120.01, 120.02, 120.04, 611

(56) References Cited

U.S. PATENT DOCUMENTS 5,532,724 A * 7/1996 Inagaki et al. ..... 347/213
5,940,111 A * 8/1999 Akada et al. ..... 347/213

FOREIGN PATENT DOCUMENTS

| | | | |
|---|---|---|---|
| EP | 0496337 A1 | 7/1992 | |
| EP | 0585852 A2 | 3/1994 | |
| EP | 0704310 A2 | 4/1996 | |
| JP | 61-262149 | 11/1986 | |
| JP | 63-81093 | 4/1988 | |
| JP | 2-121848 | 5/1990 | |
| JP | 7-117359 | 5/1995 | |
| JP | 7-186415 | 7/1995 | |
| JP | 8-58124 | 3/1996 | |
| JP | 9-300675 | 11/1997 | |
| JP | 10-58728 | 3/1998 | |

* cited by examiner

*Primary Examiner*—Huan Tran
(74) *Attorney, Agent, or Firm*—Staas & Halsey, LLP

(57) ABSTRACT

An image forming apparatus uses an ink ribbon having ink layers of different colors, and a long, film-like intermediate transfer medium. A platen for holding the medium during transfer is driven by a motor via a synchronous reduction gear whose speed reducing ratio is an integer multiple. The ink ribbon is selectively heated by a thermal head having regular polygonal or circular heat-generating portions. Under the control of a controller, the thermal head is driven on the basis of image information, and a record image containing an area gradation image is formed on the medium. This area gradation image has a color set by stacking dots having different colors in the same spot. The medium on which the record image is formed is overlapped on a target body and heated and pressed by a heat roller, thereby transferring the record image from the medium onto the target body.

15 Claims, 6 Drawing Sheets

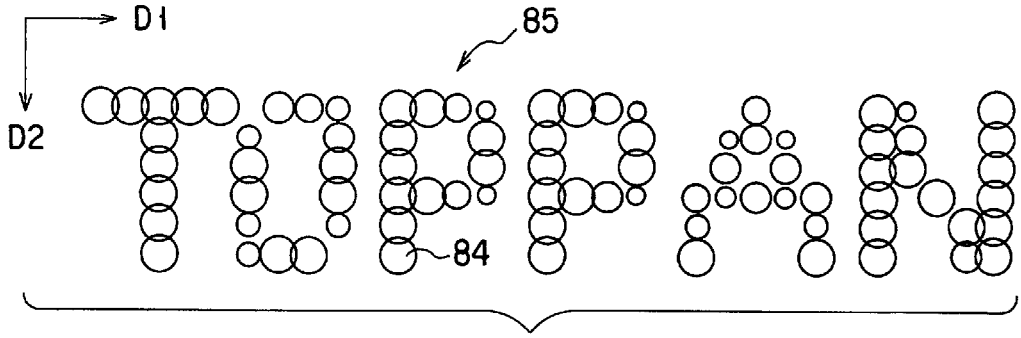
FIG. 14
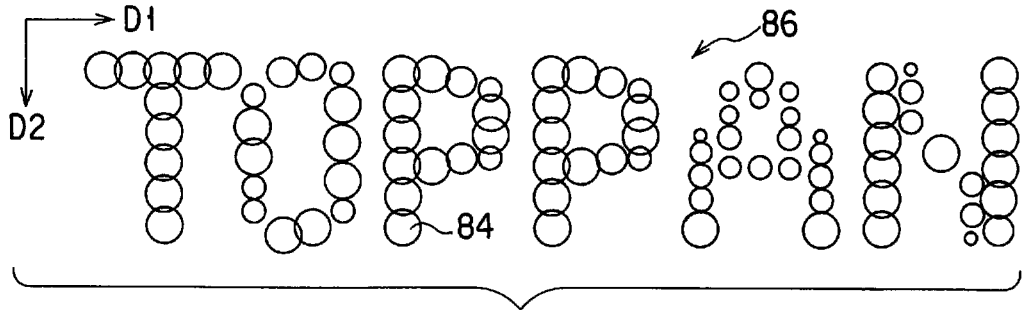
FIG. 15
FIG 16
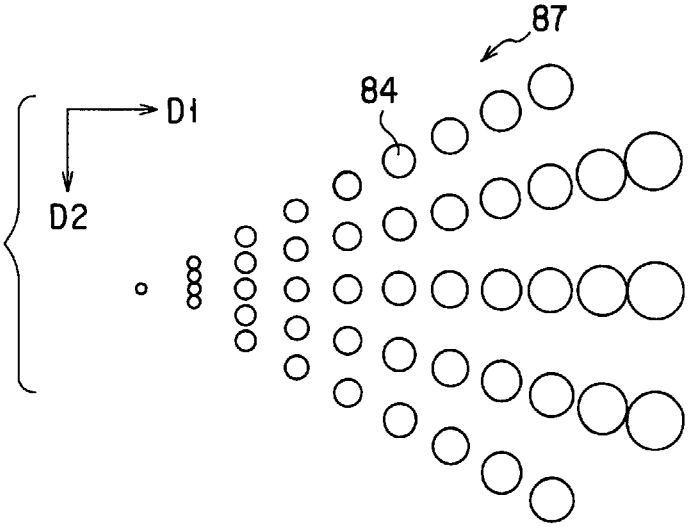

IMAGE FORMING APPARATUS AND METHOD, AND IMAGE-APPLIED ARTICLE

CROSS-REFERENCE TO RELATED APPLICATIONS

This is a Continuation Application of PCT Application No. PCT/JP99/04605, filed Aug. 26, 1999, which was not published under PCT Article 21(2) in English.

This application is based upon and claims the benefit of priority from the prior Japanese Patent Application No. 10-239950, filed Aug. 26, 1998, the entire contents of which are incorporated herein by reference.

BACKGROUND OF THE INVENTION

The present invention relates to an image forming technology for forming multicolor images using area gradation (by which gradation is set by the sizes of dots in pixels) by thermal transfer and, more particularly, to an image forming technology which uses a method (to be referred to as a dot-on-dot method hereinafter) which obtains a predetermined color by stacking dots having different colors in substantially the same spot.

A printing method is practically most widely used among other methods of writing images on a medium on the basis of image information. Other technically possible examples of the methods are a thermal transfer method to be described in the present invention, electrophotography method, ink-jet method, thermal destruction method, and various transfer recording methods using photopolymerization recording materials.

Unfortunately, any of these methods has some problems, e.g., difficulty in forming an image directly on a final recording medium (a final product) to which the image is to be given, low mass-productivity, and high cost. In cases like these, an image is formed on an intermediate transfer medium and then transferred from this intermediate transfer medium onto a final product.

When an image forming method is a thermal transfer method using, e.g., a sublimating dye, the operation is performed following a procedure explained below as is well known. First, a thermal transfer ribbon coated with a sublimating dye in a thermally transferable form and a target body as a final recording medium are overlapped on a substrate film. Subsequently, the thermal transfer ribbon is selectively heated by using a thermal head or the like on the basis of image data, thereby recording a desired image on the target body by transfer.

When the faces of different persons are to be separately recorded on different target bodies, for example, the above means can easily record a number of different images as color images having rich gradation on target bodies. This is the advantage which the printing method does not have. That is, if the printing method is used to record the faces of different persons, enormous cost, labor, and time are generally required, resulting in very poor economy.

On the other hand, materials which can be dyed by sublimating materials are limited. That is, it is possible to use only target bodies made of limited materials such as polyester, acrylic resin, and vinyl chloride resin. Hence, when thermal transfer recording using a sublimating dye is to be performed although a material other than these materials is used as a target body, some improvements are necessary as disclosed in, e.g., Jpn. Pat. Appln. KOKAI Publication No. 63-81093. In this reference, an image writing unit using a transfer ribbon of a sublimating dye and a thermal head first writes an image on a film-like intermediate transfer medium having an adhesive layer. Subsequently, a transfer unit transfers the image on this intermediate transfer medium together with the adhesive layer onto a target body by heat and pressure.

The above method is an example using a sublimating dye. In the following description, however, methods which use coloring materials other than a sublimating dye and by which an image is once formed on an intermediate transfer medium and then transferred, together with the layer in which it is formed, from this intermediate transfer medium onto a target body will be generally referred to as indirect transfer methods.

In some cases, however, images cannot be directly formed on target bodies, or enormous cost and time are required if images are to be actually formed. This happens due to various reasons when, e.g., a target body as a final product (a recording medium) has a nonuniform thickness, has a rough surface (a typical example is a contactless IC card), or is a semi-completed product such as a booklet (a typical example is a passport). In such cases, images can be formed only by indirect transfer methods in practice.

If electrophotography is used as a method of writing an image on an intermediate transfer medium on the basis of image information and if the image is a full-color image, an electrophotographic process must be repeated three times (for three colors) or four times (for four colors). The electrophotographic process of each color includes charging of a photosensitive body, formation of a latent image on the charged photosensitive body by exposure, development of a toner image corresponding to the latent image on the photosensitive body, transfer of the image to a transfer member such as a transfer drum for temporarily storing the toner image of the corresponding color, erasure of unnecessary charged portions on the photosensitive body, cleaning of the photosensitive body, and the like. In this case, therefore, the process is time-consuming and, in addition to that, it is necessary to prevent unstable image formation resulting from the use of static electricity which is very unstable.

Furthermore, since the sizes of dots of toner images for forming an image cannot be largely changed, the image is basically a binary image. Accordingly, a density change of an image cannot be expressed without using the method of pseudo area gradation using a dither matrix of Bayer type or Fatton type (including screw type). As a consequence, an image itself is coarse.

When the ink-jet method is used, on the other hand, an image is formed on an intermediate transfer medium by using a liquid ink, so the image must be dried. This also poses a problem of nozzle clogging. Additionally, since the sizes of dots cannot be largely changed even in the ink-jet scheme, the method of pseudo area gradation such as a dither matrix or an error diffusion method is used. This often decreases the resolution of an image.

Note that the thermal destruction method cannot form a full-color image at present.

For the reasons described above, image formation by the thermal transfer method using a sublimating dye is simple and inexpensive and can achieve high image quality and high resolution. Accordingly, this method is superior as an image forming method to other indirect transfer methods.

Unfortunately, this thermal transfer method using a sublimating dye has a large drawback: a sublimating dye itself is a coloring material very inferior in so-called resistances, e.g., heat resistance, light resistance, and solvent resistance. Hence, when a sublimating dye is used, the durability of an image on a target body as a final product significantly lowers. For example, even when a target body is an IC card having a heat resistance of about 120° C., a decrease in image density due to a phenomenon such as thermal decomposition or resublimation of a sublimating dye occurs at about 80° C. That is, no sublimating dye can have a heat resistance exceeding a heat resistance of 120° C. of a target body.

Also, when paper such as a passport is used as a target body, an image transferred onto the paper surface "oozes out" from the back side owing to the ambient of a solvent such as paradichlorobenzene or naphthalene often used as a mothproofing agent. Additionally, a sublimating dye resublimates from the paper fibers at high temperatures, and this lowers the image density.

Furthermore, since the sublimating printing method is in widespread use in the world, if this method is used for a security purpose of, e.g., a passport, the passport is readily forged or altered. In addition, this forgery or alteration cannot be easily found.

To solve these problems unique to a sublimating dye and achieve simplicity, low cost, high image quality, and high resolution of the thermal transfer method, a melt-transfer printing method using area gradation is very effective. This method obtains gradation by changing the sizes of dots to be transferred in accordance with the amount of heat generated by a thermal head used in thermal transfer. That is, area gradation is possible by changing a region in which an ink-ribbon ink is softened or melted, in accordance with the controlled heat amount from the thermal head.

In this method, an ink ribbon is formed by previously applying an ink onto a substrate film such as polyethyleneterephthalate (to be abbreviated as PET hereinafter) or polyethylenenaphthalate (to be abbreviated as PEN hereinafter) by a printing method or the like. An ink is formed by appropriately internally adding an organic dye or a coloring material such as an organic or inorganic pigment to a binder resin, e.g., polymethylmethacrylate, polybutyral, or a vinyl chloride-vinyl acetate copolymer, and internally adding a wax component, filler, and the like if necessary.

Since in this method a dye other than a sublimating dye or a pigment can be used as a coloring material, the durability such as the heat resistance, solvent resistance, and light resistance can be greatly improved. Accordingly, the method has high requirement conformity in the fields of, e.g., a passport, visa, and auto-driving license, requiring high durability.

Also, the melt-transfer method using area gradation is very sensitive to the roughness of a recording medium; images cannot be directly transferred or formed if a recording medium has even a slight roughness. This makes the melt-transfer method suitable to the indirect transfer method. In other words, it is nearly impossible to obtain high-quality images by the melt-transfer method using area gradation unless the indirect transfer method is used.

Methods (dot mapping) of arranging dots of different colors when the above-mentioned area gradation is to be formed by a color image, i.e., multicolor inks, are roughly divided into two methods.

One is a screen method widely used in, e.g., an offset printing method. The other is a method of arranging dots of different colors in substantially the same spot, i.e., a dot-on-dot method.

First, the screen method will be described below.

When dot images (point images) of two or more colors are to be mapped, dots formed by a thermal head form a substantially regular dot array. For example, when a thermal head having a resolution of 300 dpi (the dpi is a unit indicating the number of dots per inch) in the main scan direction is used and dots are mapped by the same resolution of 300 dpi in the sub-scan direction, these dots form a mass of lattices at intervals of approximately 85 $\mu$m. Note that in this specification, the main scan direction is the longitudinal direction in which heat-generating portions of a thermal head are arrayed, and the sub-scan direction is perpendicular to this main scan direction.

When such regular dot masses are recorded on a recording medium by transfer (in the present invention, this corresponds to image formation on an intermediate transfer medium), slight differences to some extent are unavoidably produced between the mapped positions of different colors owing to a positional deviation (caused in many cases by, e.g., velocity variations in the sub-scan direction or holding slip of the recording medium) in the sub-scan direction. If a slight positional deviation is present when different colors are overlapped although each single color is regular, this deviation component induces a beat phenomenon with the mapping of each color, resulting in unfavorable "moire" on the recorded image.

To shift the mapping position of each color in advance, therefore, the angle of lattice-like mapping is changed (the screen angle is changed), or the resolution of the color is changed (e.g., one pixel is formed by two dots). In either case, the appearance of moire is prevented by using a method of performing dot mapping so as to intentionally prevent regular overlapping of dots having different colors, i.e., by using a screen method.

When this screen method is used, however, the apparent resolution (the gradation resolution) lowers (to 75 to 150 dpi for a 300-dpi thermal head). In addition, individual colors are apparently arranged at random, and this sometimes makes images look rough. Furthermore, each color image must be changed into a screen image. This imposes a large load on an internal control CPU of a printer or on a CPU of a host computer or the like which sends image data to a printer, thus finally delaying the time of issue greatly.

Also, when an image is formed on a target body for a security purpose such as a passport by using this mapping method, the image looks analogous to those formed by offset printing and gravure printing. This makes the characteristics of the printing method difficult to use to achieve the effect of suppressing illegal use such as alteration or forgery.

On the other hand, the dot-on-dot method is a method of mapping dots having different colors in substantially the same position with high accuracy. Therefore, problems such as moire and apparent color tone shift caused by color shift do not occur unless the positions of these colors deviate from each other. Also, images can be formed with the maximum resolution of a thermal head. In addition, since image mapping is not basically changed, no load is imposed on a CPU. As a consequence, the speed of issue can be increased.

Unfortunately, this dot-on-dot method has scarcely been put into practical use because no technique for accurately overlapping different colors has been established.

BRIEF SUMMARY OF THE INVENTION

The present invention has been made in consideration of the above-mentioned problems of the conventional techniques, and has as its object (the first object) to provide an image forming apparatus and method which, when an image is to be recorded on an intermediate transfer medium by transfer, can achieve area gradation by using substantially truly circular dots in a dot-on-dot manner by improving a driving system of a holding member, such as a platen roller, for holding the intermediate transfer medium, and improving a thermal head as a writing device.

It is another object (the second object) of the present invention to provide an image-applied article formable by the above image forming apparatus or method and highly effective to prevent illegal acts such as alteration and forgery or highly effective to facilitate finding such illegal acts.

The first aspect of the present invention is an image forming apparatus which uses a thermal transfer ribbon having a plurality of ink layers of different colors containing a coloring material selected from the group consisting of a pigment and dye, and a long, film-like intermediate transfer medium capable of transferring the ink layers from the thermal transfer ribbon, comprising a platen for holding the intermediate transfer medium when the ink layers are transferred from the thermal transfer ribbon to the intermediate transfer medium, a driving mechanism which comprises a driving source and transmission members and drives the platen, the transmission members being interposed between the driving source and the platen to mesh with each other and having a speed reducing ratio which is an integer multiple, a thermal head which has a substantially regular polygonal or substantially circular heat-generating portion and selectively heats the thermal transfer ribbon while the intermediate transfer medium and the thermal transfer ribbon are overlapped on the platen, thereby selectively transferring the ink layers onto the intermediate transfer medium, control means for forming a record image containing an area gradation image on the intermediate transfer medium by driving the thermal head, on the basis of image information, in collaboration with driving of the platen by the driving mechanism, the area gradation image being made up of sets of dots having different colors formed by the ink layers and having a color set by stacking the dots having different colors in substantially the same spot, and heating and pressing means for overlapping the intermediate transfer medium on which the record image is formed and a target body and applying heat and pressure to the intermediate transfer medium and the target body, thereby transferring the record image from the intermediate transfer medium onto the target body.

The second aspect of the present invention is an image forming apparatus according to the first aspect, wherein the intermediate transfer medium comprises an image-receiving layer, and the record image is formed on the image-receiving layer and transferred together with the image-receiving layer onto the target body.

The third aspect of the present invention is an image forming apparatus according to the first aspect, further comprising punching means for punching the intermediate transfer medium along the contour of the target body and transferring the record image together with the punched portion of the intermediate transfer medium onto the target body.

The fourth aspect of the present invention is an image forming apparatus according to any one of the first to third aspects, wherein the record image further contains a binary image.

The fifth aspect of the present invention is an image forming apparatus according to any one of the first to third aspects, wherein the driving source is a stepping motor driven by the number of steps by which a speed reducing ratio is an integer multiple with respect to the transmission members.

The sixth aspect of the present invention is an image forming method which uses a thermal transfer ribbon having a plurality of ink layers of different colors containing a coloring material selected from the group consisting of a pigment and dye, and a long, film-like intermediate transfer medium capable of transferring the ink layers from the thermal transfer ribbon, comprising an image forming step of forming a record image containing an area gradation image on the intermediate transfer medium on the basis of image information by repeating an operation of selectively heating the thermal transfer ribbon by a thermal head while the intermediate transfer medium and the thermal transfer ribbon are overlapped on a platen, the area gradation image being made up of sets of dots having different colors formed by the ink layers and having a color set by stacking the dots having different colors in substantially the same spot, and a driving mechanism of the platen comprising a driving source and transmission members interposed between the driving source and the platen to mesh with each other and having a speed reducing ratio which is an integer multiple, and a heating and pressing step of overlapping the intermediate transfer medium on which the record image is formed and a target body and applying heat and pressure to the intermediate transfer medium and the target body, thereby transferring the record image from the intermediate transfer medium onto the target body.

The seventh aspect of the present invention is an image forming method according to the sixth aspect, wherein the intermediate transfer medium comprises an image-receiving layer, and the record image is formed on the image-receiving layer and transferred together with the image-receiving layer onto the target body.

The eighth aspect of the present invention is an image forming method according to the sixth aspect, further comprising the punching step of punching the intermediate transfer medium along the contour of the target body and transferring the record image together with the punched portion of the intermediate transfer medium onto the target body.

The ninth aspect of the present invention is an image forming method according to any one of the sixth to eighth aspects, wherein the record image further contains a binary image.

The 10th aspect of the present invention is an image forming method according to the ninth aspect, wherein the image forming step comprises a step of forming, as the binary image, micro characters made up of elements selected from the group consisting of characters, numbers, symbols, seals, and patterns, by using sets of the dots.

The 11th aspect of the present invention is an image forming method according to the ninth aspect, wherein the image forming step comprises a step of forming, as the binary image, a pattern for generating moire when the record image is read by a scanner, by using sets of the dots.

The 12th aspect of the present invention is an image-applied article comprising a substrate, a record image, and a transparent resin layer formed on the substrate to cover the record image such that the record image is visible, wherein the record image contains an area gradation image and binary image, the area gradation image is made up of sets of dots having different colors formed by ink layers and has a color set by stacking the dots having different colors in substantially the same spot, the binary image comprises micro characters formed by using sets of the dots and made up of elements selected from the group consisting of characters, numbers, symbols, seals, and patterns.

The 13th aspect of the present invention is an image-applied article according to the 12th aspect, wherein the micro characters represent personal information pertaining to a main part of the record image.

The 14th aspect of the present invention is an image-applied article comprising a substrate, a record image, and a transparent resin layer formed on the substrate to cover the record image such that the record image is visible, wherein the record image contains an area gradation image and binary image, the area gradation image is made up of sets of dots having different colors formed by ink layers and has a color set by stacking the dots having different colors in substantially the same spot, the binary image comprises a pattern formed by using sets of the dots to generate moire when the record image is read by a scanner.

The 15th aspect of the present invention is an image-applied article according to the 14th aspect, wherein the pattern for generating moire is formed such that thin lines extend in a plurality of different oblique directions by dots formed at a high-resolution pitch.

In the present invention as described previously, dots having different colors are formed in substantially the same spot as one requirement for forming an image by area gradation. The meaning of "substantially the same spot" includes very slight positional deviations between stacked dots having different colors. That is, "substantially the same spot" mentioned in the present invention includes a case in which, of stacked dots different in color, the distance between the centers of dots of colors most deviated from each other is within approximately ⅓ the dot formation pitch corresponding to the resolution. In the present invention, to obtain a high-quality, high-area gradation image, it is important to stack dots with very high positional accuracy such that the center-to-center distance is preferably within ¼ the dot pitch.

Also, a "substantially regular polygonal shape" or a "substantially circular shape" of the heat-generating portion mentioned in the present invention naturally includes a true regular polygon (including a true square) or a true circle. However, this "substantially regular polygonal" or "substantially circular" shape is not necessarily restricted to a true regular polygon or true circle. The whole heat-generating portion corresponding to one dot need only have a shape macroscopically similar to a regular polygon or circle.

That is, the corners of a polygon can be chamfered or rounded with a small radius, or its contour need not be partially or entirely composed of straight lines or curved lines. Simple examples are: (1) an octagon (not a regular octagon) having eight corners but assuming a shape similar to a square whose four corners are slightly chamfered; (2) a pentagon (not a regular pentagon) substantially close to a square, i.e., four interior angles are close to 90° but the remaining one interior angle is extraordinarily large (around 180°); and (3) a shape formed by rounding the four corners of a square, which is not a polygon (or a regular polygon) because it has no corners. Any of these shapes corresponds to a "substantially regular polygonal shape" mentioned in the present invention. Also, a "substantially circular shape" can be an ellipse or a more or less distorted circle in a strict sense.

The number of corners of a regular polygon is not limited to a specific once, i.e., a regular polygon can have any number of corners as long as the polygon can be manufactured in practice. When the number of corners increases, the shape ultimately becomes close to a true circle. Also, when the number of corners of a regular polygon is small, favorable results meeting the objects of the present invention are readily obtained if the number is an even number rather than an odd number. When the number of corners is large, no big difference is produced regardless of whether the number is an odd number or even number.

As a macroscopic dimensional ratio of the shape of the heat-generating portion, the ratio of the width of a widest portion of the shape to the width in a direction perpendicular to the direction of the widest portion is preferably as close to 10:10 as possible, regardless of whether the shape is a "substantially regular polygonal" or "substantially circular" shape. However, even if this ratio more or less changes, there is a range within which well favored results are obtained in practice. Although this range cannot necessarily be defined, a rough standard is about 10:7 to 7:10.

In practice, a square, a rectangle close to a square, or a shape substantially close to these shapes is preferred because of the ease of design and manufacture and the power of influence with which favorable results meeting the objects of the present invention are obtained.

Note that one heat-generating portion usually forms one dot on a target body. However, when a heat-generating portion for forming one dot on a target body is composed of a plurality of small heat-generating portions, the whole of these small heat-generating portions for forming one dot need only macroscopically have a "substantially regular polygonal" or "substantially circular" shape.

When the heat-generating portion of the thermal head has a substantially square or circular shape, formed dots are also circular dots, and this facilitates area gradation. Note that when a thermal transfer ribbon in which an ink layer is formed on a substrate film and the thickness of this ink layer is 1 $\mu$m or less, the ink layer can be easily cut, so area gradation can be readily performed.

The platen is driven by synchronous drive transmitting means, such as timing belts or gears, which produce no slip, and each driving speed reducing ratio is set to be an integer multiple. Accordingly, the ripple periods of the power transmission torque ripples of individual reduction gears are equal to each other. Therefore, images can easily be formed by beautifully overlapping dot images of different colors.

A representative example of a particularly suitable thermal transfer ribbon is the one disclosed in Jpn. Pat. Appln. KOKAI Publication No. 7-117359 (U.S. Pat. No. 5,726,698) (in this reference, the thermal transfer ribbon is represented as a "thermal transfer recording material"). By the use of this thermal transfer ribbon, images having undergone good area gradation can be formed by a heat-bonding thin film peeling method (represented in the above reference).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 14 is a view showing an example of micro characters;

FIG. 15 is a view showing another example of micro characters; and

FIG. 16 is a view showing a moire-generating pattern.

DETAILED DESCRIPTION OF THE INVENTION

Figure 1:
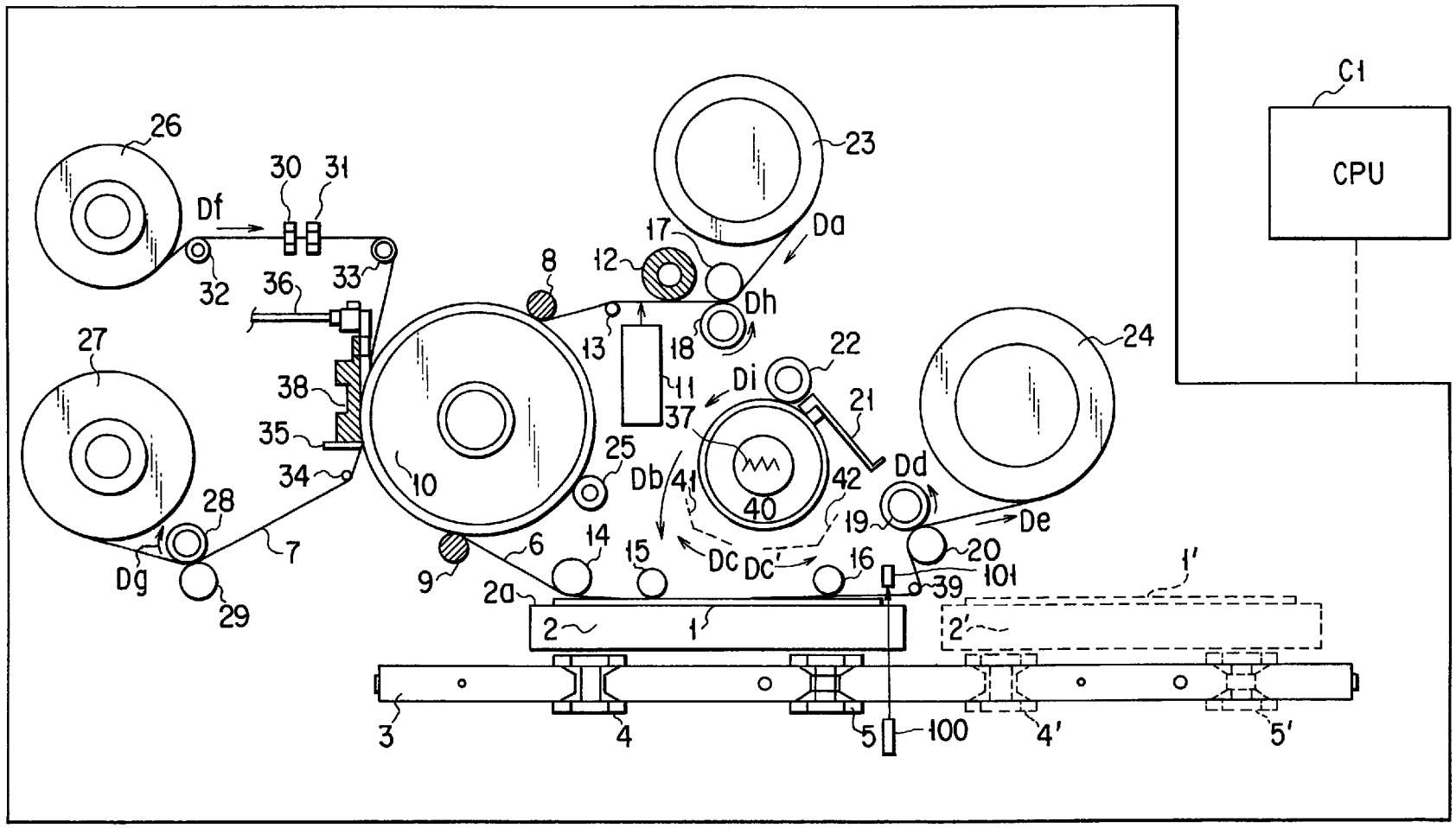
FIG. 1 is a schematic view showing the arrangement of an image forming apparatus according to an embodiment of the present invention.

FIG. 1 is a schematic view showing the arrangement of an image forming apparatus according to an embodiment of the present invention.

A target body 1 (1') is set on a tray 2 (2') via a base rubber sheet 2*a* made of silicone rubber and having a surface coated with a fluorocarbon-based polymer compound. Referring to FIG. 1, the positions of the target body 1 and the tray 2 indicated by the solid lines are positions when an image on an intermediate transfer medium 6 is heated and pressed against the target body by a heat roller 40. Also, the target body is conveyed by moving a rail 3 by wheels 4 (4') and 5 (5') by an actuator (not shown) and a driving system. When the target body 1 is a product, such as a card, having rigidity to some extent compared to a booklet such as a passport or a notebook, the tray 2 can be omitted.

Figure 8:
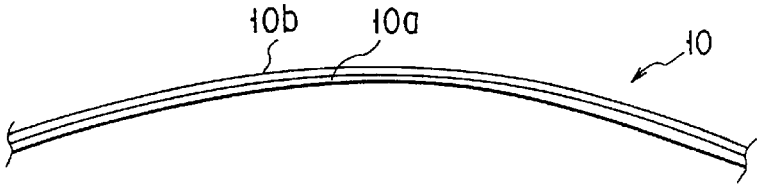
FIG. 8 is a schematic sectional view showing the surface structure of a platen roller of the image forming apparatus shown in FIG. 1.

The intermediate transfer medium 6 is supplied from a supply reel 23 and conveyed to a take-up reel 24 by guide rollers 13, 15, 16, and 39, a conveyor roller 17, a conveyor roller 18 (which rotates in a direction Dh when advancing the medium), a conveyor roller 20, and a conveyor roller 19 (which rotates in a direction Dd when advancing the medium). When an image is to be written, the intermediate transfer medium 6 is held on a platen roller 10 by clamp rollers 8 and 9. As shown in FIG. 8, the platen roller 10 has a surface structure in which an elastic layer 10*a* is covered with a rigid layer 10*b*. For example, the elastic layer 10*a* is made of a silicone-based elastomer, and the rigid layer 10*b* is made of a fluorocarbon-based polymer compound. A cleaning roller 25 is used to remove dust from the surface of the platen roller 10.

Figure 6:
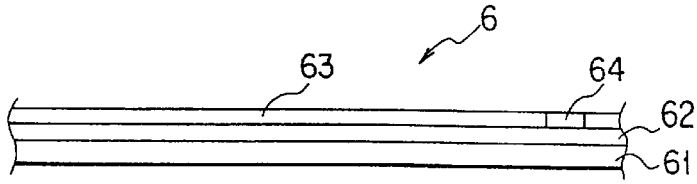
FIG. 6 is a schematic sectional view showing an intermediate transfer medium of the image forming apparatus shown in FIG. 1.

As shown in FIG. 6, the intermediate transfer medium 6 includes a long substrate film 61 and, for example, a transparent resin protective layer 62 and a resin image-receiving layer/heat-bonding layer 63 stacked on the substrate film 61. The intermediate transfer medium 6 also contains a security image layer which uses an image obtained by hologram or a diffraction grating. A register mark sensor 11 for aligning the position of the image obtained by hologram or the like aligns the position of the intermediate transfer medium 6 on the platen roller 10. A cleaning roller 12 and a charge removal brush (not shown) are used to remove dust from the surface on which an image is to be written of the intermediate transfer medium 6.

A slack adjusting device is preferably disposed midway along the convey path of the intermediate transfer medium 6 to adjust slack or tension of the intermediate transfer medium 6. This slack adjusting device not only adjusts slack or tension of the intermediate transfer medium 6 but also is effective in the following case. That is, the device can significantly increase the processing speed when the preceding stage (a step of forming a record image on the intermediate transfer medium 6) of image formation and the subsequent stage (a step of transferring the record image on the intermediate transfer medium onto a target body) of image formation are independently performed in parallel, or when images are repeatedly formed in units of colors in the preceding stage of image formation.

In this embodiment, an image is written by thermal transfer using an ink which contains an organic or inorganic pigment as a coloring material (a binder contained in the ink layer is transferred along with the coloring material). While the intermediate transfer medium and a thermal transfer ink ribbon 7 are overlapped on the platen roller 10, the ribbon 7 is selectively heated by a thermal head 38 to selectively transfer the ink layer on the ribbon 7 onto the intermediate transfer medium.

Figure 9:
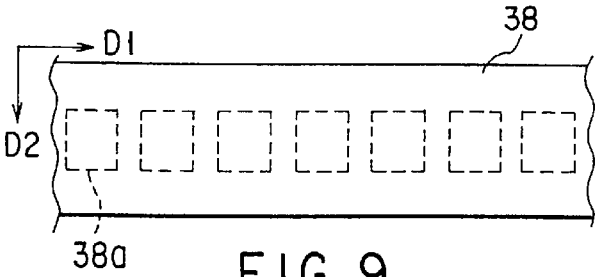
FIG. 9 is a schematic plan view showing a thermal head of the image forming apparatus shown in FIG. 1.
Figure 10:
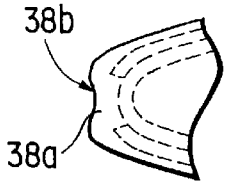
FIG. 10 is a schematic side view showing the thermal head of the image forming apparatus shown in FIG. 1.

As shown in FIG. 9, the thermal head 38 is of heat concentration type and has a plurality of heat-generating portions 38*a* arranged in a line in the main scan direction and each having a substantially regular polygonal planar shape or a substantially circular planar shape. As shown in FIG. 10, this thermal head 38 forms a smooth, mountain-like, curved heating surface 38*b* having a surface roughness of Ra (average surface roughness)=50 to 100 nm. In this specification, the main scan direction is the longitudinal direction (the longitudinal direction of a line thermal head), along which the heat-generating portions 38*a* of the thermal head 38 are arrayed, and which equals the widthwise direction of the intermediate transfer medium 6. The sub-scan direction is perpendicular to the main scan direction and equals the longitudinal direction of the intermediate transfer medium 6.

In this embodiment, each heat-generating portion 38*a* of the thermal head 38 has a rectangular shape, close to a square, having dimensions of 70 μm [main scan direction]× 80 μm [sub-scan direction]. By adjusting the temperature of these heat-generating portions of the thermal head 38, the size of a dot to be formed can be changed to an arbitrary size. That is, an image is given gradation by changing the sizes of dots in accordance with image information. Gradation can be expressed by either a color mixture using multiple colors or a single color.

A voltage is supplied to the heat-generating portions 38*a* of the thermal head 38 through a cable 36. Also, a peel plate 35 for peeling off the ink ribbon 7 from the intermediate transfer medium 6 is disposed at the exit of the thermal head 38.

Figure 7:
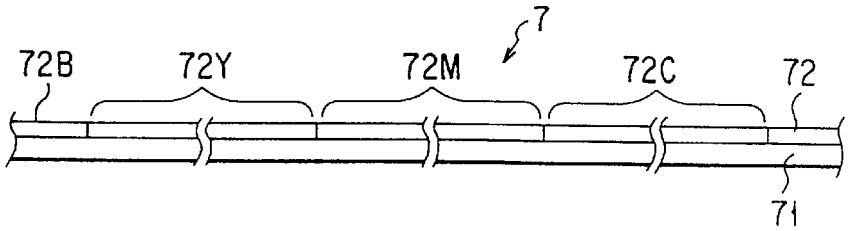
FIG. 7 is a schematic sectional view showing an ink ribbon of the image forming apparatus shown in FIG. 1.

As shown in FIG. 7, the thermal transfer ink ribbon 7 includes a long substrate film 71 and a plurality of ink layers 72 having different colors formed on the substrate film 71. Each ink layer 72 contains a coloring material (in this embodiment, a molten ink using a pigment) selected from the group consisting of a pigment and dye. These ink layers 72 of the ribbon 7 include, e.g., layers 72Y, 72M, and 72C of three colors Y (yellow), M (magenta), and C (cyan) for forming an area gradation image, and a layer 72B of B (black) for forming a binary image. These ink layers 72Y, 72M, 72C, and 72B differing in color of the ink ribbon 7 are sequentially repeatedly formed on the substrate film 71 such that each color forms an independent region of a predetermined length in the supply direction of the ribbon 7.

In addition to the Y, M, C, and B color ink layers, an ink layer of another color (e.g., a special color such as gold, silver, a fluorescent material, a phosphorescent material, or an IR absorbing material) or a layer (e.g., an adhesive layer or a protective layer) other than an ink layer can be formed on the ink ribbon 7. These additional layers can be appropriately formed by designing before, after, or between the ink layers of the three primary colors in the longitudinal direction of the ink ribbon 7. In image formation according to the present invention, a predetermined color is obtained by the dot-on-dot method by which dots having different colors are stacked in substantially the same spot. Therefore, the thickness of an ink layer as the thickness of each dot is desirably 1 μm or less to easily and reliably obtain high image quality with good gradation.

The ink ribbon 7 is supplied by a supply reel 26 and conveyed to a take-up reel 27 by a guide roller 34, a conveyor roller 28 (which rotates in a direction Dg when advancing the ribbon), a conveyor roller 29, and cleaning rollers 32 and 33 also serving as guide rollers. In a position where this ink ribbon 7 opposes the platen roller 10, the ink ribbon 7 is selectively heated on the basis of image information by the heat concentration type thermal head 38. Consequently, the ink layers are selectively transferred onto the intermediate transfer medium 6 in accordance with the image.

Sensor marks are previously formed on the ink ribbon 7 to distinguish between the individual colors. Sensors 30 and 31 read these sensor marks to distinguish between and align regions corresponding to the ink layers of different colors.

The intermediate transfer medium 6 thus given the image is heated and pressed against the target body 1 by the heat roller 40 which is moved down along a direction Db. Consequently, the heat-bonding layer 63 also serving as an image-receiving layer in which the image is formed, a hologram layer 64, a protective layer 62, and the like on the intermediate transfer medium 6 are collectively transferred as one image layer onto the target body 1. Shutters 41 and 42 are arranged for safety between the heat roller 40 and the target body 1. Only when the heat roller 40 falls in the direction Db, these shutters 41 and 42 open in directions Dc and Dc', respectively. These shutters 41 and 42 are normally closed so that a human hand or the like is not burnt by touching the heat roller 40.

Figure 11:
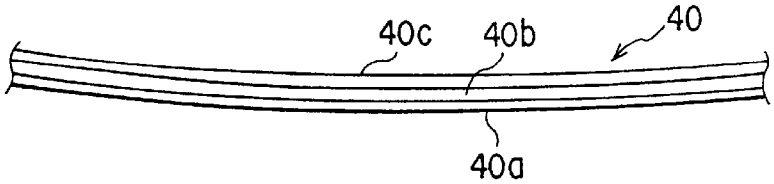
FIG. 11 is a schematic sectional view showing the surface structure of a heat roller of the image forming apparatus shown in FIG. 1.

The heat roller 40 has a built-in halogen lamp heater 37 and also comprises a hollow cylinder 40*a*. The interior of this hollow cylinder 40*a* is blackened to absorb heat radiation from the halogen lamp heater. As shown in FIG. 11, the surface of the hollow cylinder 40*a* is covered with thermally vulcanizable silicone rubber 40*b* which is covered with a conductive fluorocarbon-based polymer compound 40*c*. This heat roller 40 has as a whole an inverse crown shape in which the diameter gradually increases from the center toward the outside. The heat roller 40 is rotated at a peripheral speed (the rotating direction is Di) slightly higher than the conveyance speed of the intermediate transfer medium and the target body. This intentionally generates tension outside the center of the intermediate transfer medium being heated and pressed, thereby preventing generation of wrinkles on the intermediate transfer medium or destruction of a security image.

A temperature sensor 21 senses the surface temperature of the heat roller 40, and a temperature controller (not shown) holds this surface temperature constant. A cleaning roller 22 is used to keep the surface of the heat roller 40 clean.

The main purpose of the cleaning rollers 12, 22, 25, 32, and 33 described above is to remove foreign matter sticking to the surfaces of the ink ribbon 7, the intermediate transfer medium 6, the platen roller 10, the heat roller 40, and the like.

A controller C1 controls the whole operation of this image forming apparatus, e.g., supply of the intermediate transfer medium 6 and the ink ribbon 7 and driving of the platen roller 10, the thermal head 38, and the heat roller 40, on the basis of programs previously input to the controller C1.

Other detailed conditions of the image forming apparatus according to this embodiment are as follows.

<Target body 1>

A paper substrate having a thickness of 200 to 800 μm was used.

<Base rubber sheet 2*a*>

Silicone rubber (JIS(A) rubber hardness=50°) was used.

The surface was coated with an ethylene tetrafluoride polymer or a polypyrene hexafluoride polymer.

<Intermediate transfer medium 6>

A multicoated 25-μm thick PET base was used.

The outermost surface portion was an image-receiving layer/heat-bonding layer made of a resin mixture principally consisting of a urethane resin or an epoxy resin.

<Ink ribbon 7>

An organic pigment-based coloring material was used.

An inorganic pigment was used as black.

The thickness of an ink layer was 0.2 to 0.6 μm.

<Thermal head 38>

Heat-generating portions were of heat concentration type.

The density of these heat-generating portions was 300 dots/inch.

The shape of each heat-generating portion was substantially a square (70 μm×80 μm).

<Heat roller 40>

A halogen lamp heater was used as a heat source.

The temperature was controlled by detecting the surface temperature of the roller.

High tensile aluminum having a blackened inner surface was used as a core.

0.5-mm thick thermally vulcanizable silicone rubber was used as an elastomer layer.

As a roller surface material, a copolymer of ethylene tetrafluoride and perfluoroalkylvinylether that was given conductivity was used.

The roller surface shape was an inverse crown shape, and the peripheral speed was slightly higher than the medium conveyance speed.

The roller surface temperature was 180° C.

The heating/pressing rate was 15 mm/sec.

The heating/pressing linear load was 3.0 kgf/cm.

A drive transmitting system of the image forming apparatus shown in FIG. 1 will be described below.

In this embodiment, the platen roller 10 is used as an intermediate transfer medium holding member, and a stepping motor is used as a driving source of this platen roller 10. Motors such as a stepping motor are usually connected to a member to be driven via a certain reduction gear mechanism for the following two reasons: to obtain enough torque to rotate the platen roller 10 and the like, and to reduce the speed to an appropriate driving speed.

Reduction gear mechanisms are classified into an "asynchronous" reduction gear mechanism using V belts and flat belts and a "synchronous" reduction gear mechanism using timing belts and spur gears or helical gears. An asynchronous reduction gear mechanism causes a certain slip phenomenon such as belt slip and hence is unsuited to precise alignment.

A synchronous reduction gear mechanism using timing belts and gears (e.g., involute gears or cycloid gears) basically causes no slip phenomenon, since the teeth of transmission members mesh with each other. However, this synchronous reduction gear mechanism has errors of the tooth profiles of gears and timing belts and errors of meshing. These errors produce "positional deviation".

Figure 2:
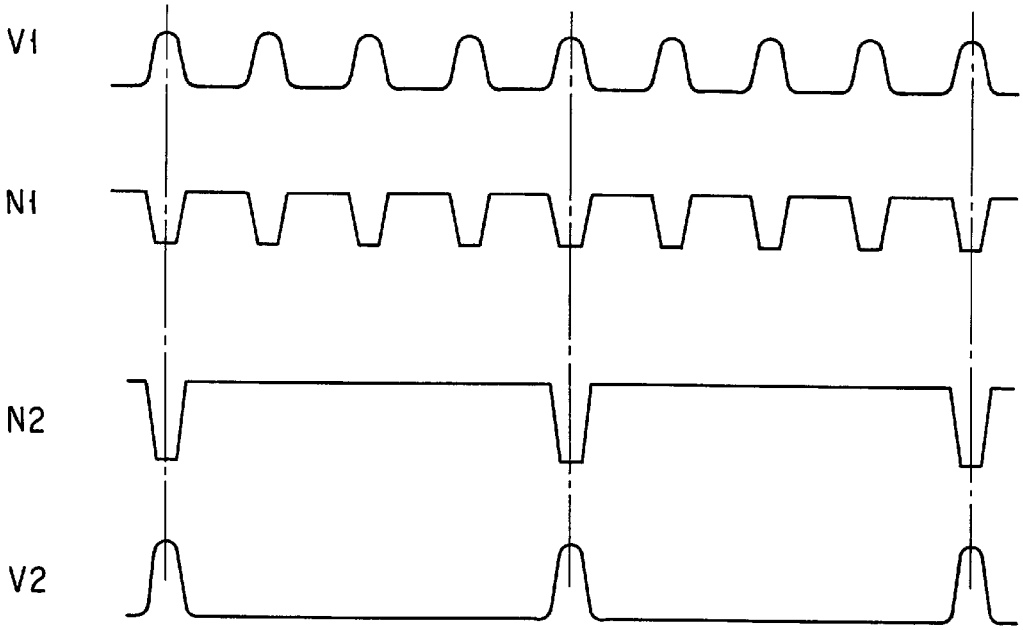
FIG. 2 is a timing chart for explaining the speed reducing timings of a timing belt for increasing the torque and reducing the speed in the image forming apparatus shown in FIG. 1.

FIG. 2 shows the speed reducing timings of a timing belt for reducing the speed and increasing the torque in the power by reducing the speed from N1 to N2. In this example, the speed reducing ratio from N1 to N2 is an integer multiple, such as 4:1, as a teeth number ratio. Timing belts have more or less variations between products, and this periodically produces errors when a pulley and a belt mesh. Positional deviations (the first-order integral components of speed variations) generated by these errors also have periodic variations, such as V1 for N1 and V2 for N2, synchronized with their respective teeth.

When the speed reducing ratio between the timing belt and the pulley, i.e., between the transmission members is set to be an integer multiple, the meshing periods of their teeth, i.e., the cogging periods of the positional deviations are always synchronized. This synchronizes the periods of positional deviations caused by meshing errors between the transmission members.

If, however, the speed reducing ratio between the transmission members is not an integer multiple (e.g., 4:1.33), the positional deviations cannot be synchronized. Consequently, the positional deviations themselves build up to make it difficult to constantly drive the conveyor system in the same position. Alternatively, steps necessary for the countermeasure or mechanisms for these steps are required.

Gears are analogous to timing belts. For example, an involute gear basically produces no speed variations if its tooth profile has an ideal shape. Therefore, no positional deviation as a first-order integral component is presumably produced. However, periodic positional deviations are unavoidably produced by, e.g., the inability to obtain ideal gear accuracy (particularly ideal tooth profile accuracy) and elastic deformation of a tooth profile or tooth trace deformation caused by friction and wear in use. These matters hold for cycloid gears and other general synchronous reduction gear mechanisms.

Figure 3:
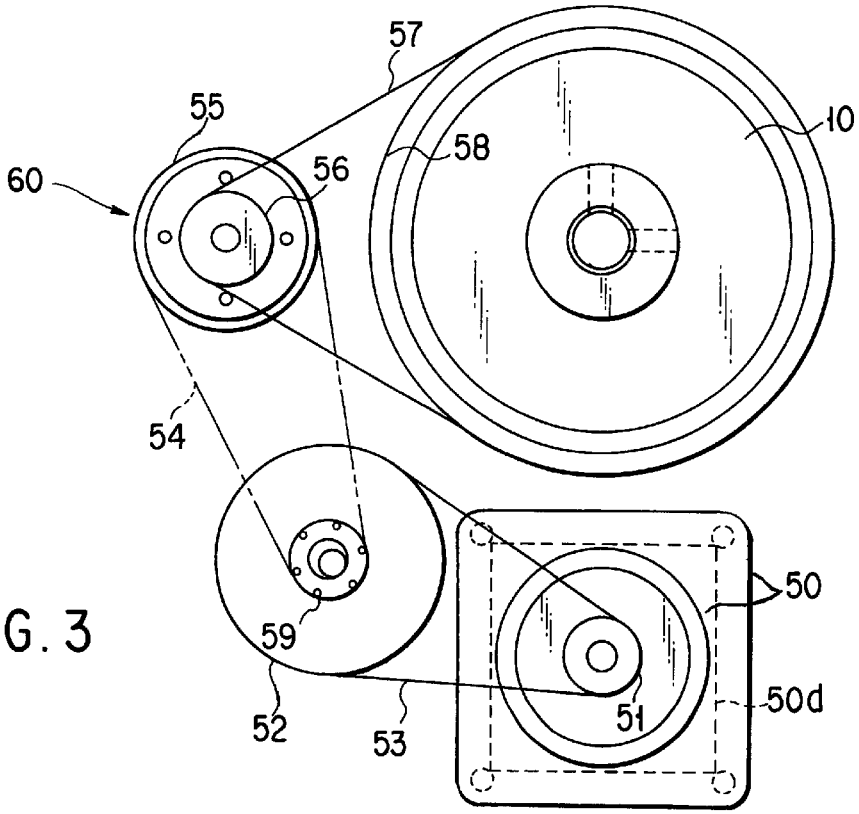
FIG. 3 is a view for explaining a platen roller driving system in the image forming apparatus shown in FIG. 1.

FIG. 3 is a view showing a drive transmitting system for transmitting drive from a stepping motor 50 to a pulley 58 directly coupled with the platen roller 10. As shown in FIG. 3, the driving force of the stepping motor 50 is transmitted, while its driving speed is reduced, from a gear pulley 51 to a gear pulley 52 via a timing belt 53. This driving force is then transmitted, while its driving speed is reduced, from a small-diameter gear pulley 59 coaxial with the gear pulley 52 to a gear pulley 55 of an electromagnetic clutch 60 for turning on and off the transmission of the driving force, via a timing belt 54. Furthermore, the driving force is transmitted, as its driving speed is reduced, from a small-diameter gear pulley 56 coaxial with the gear pulley 55 to the gear pulley 58 directly coupled with the platen roller, via a timing belt 57.

Figure 4:
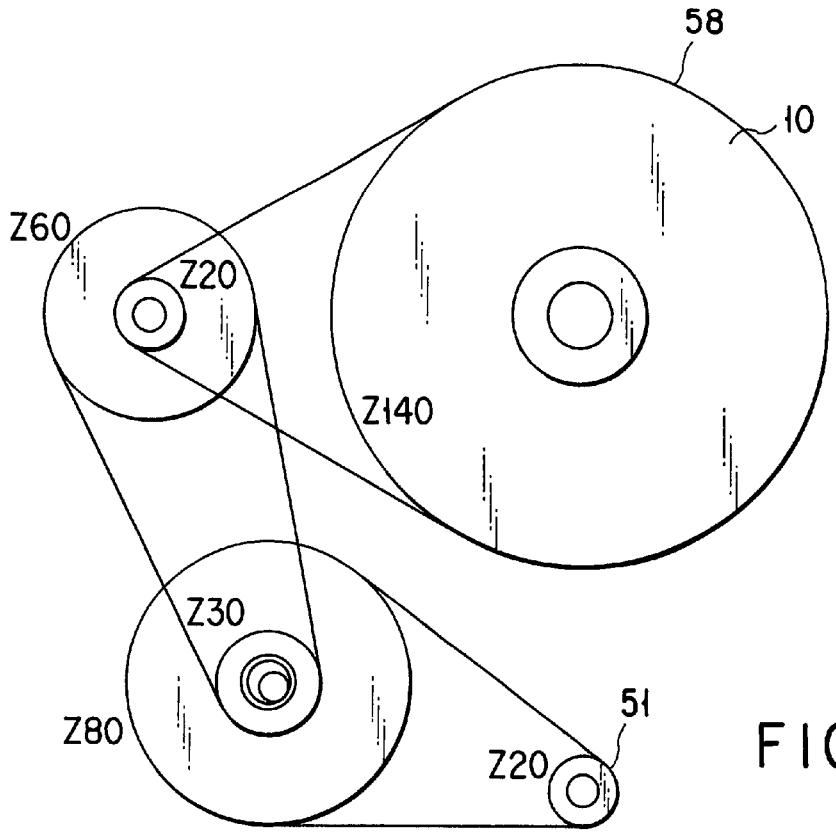
FIG. 4 is a view showing an example of the speed reducing ratios, i.e., the teeth number ratios between transmission members of the drive transmitting system shown in FIG. 3.
Figure 5:
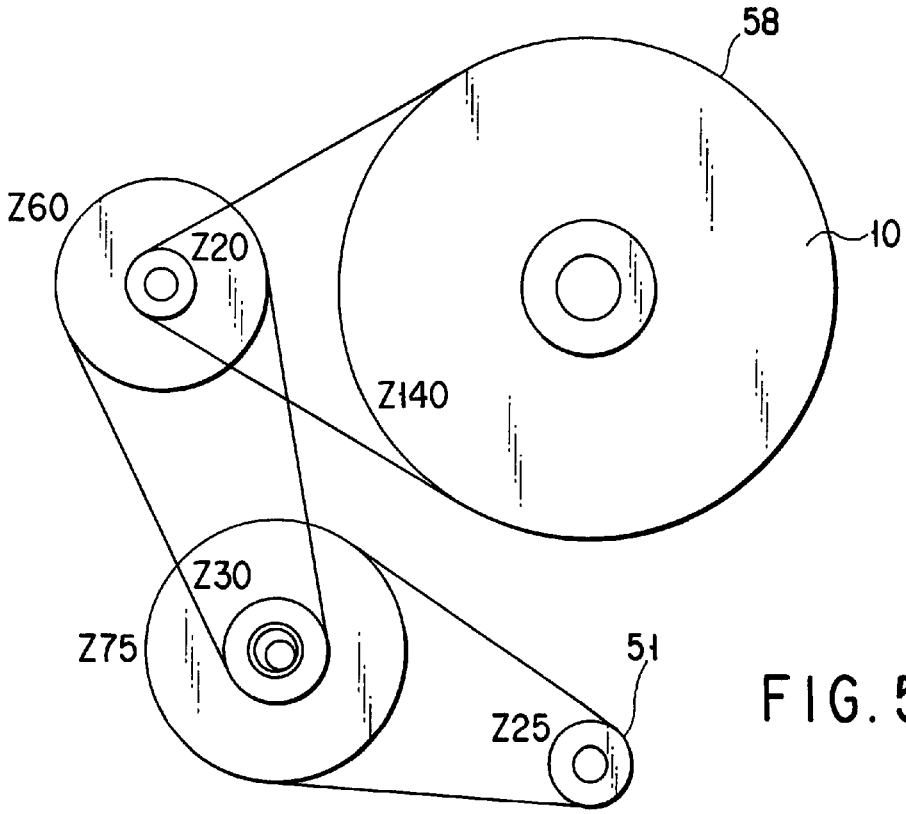
FIG. 5 is a view showing another example of the speed reducing ratios, i.e., the teeth number ratios between transmission members of the drive transmitting system shown in FIG. 3.

FIGS. 4 and 5 are views showing the speed reducing ratios, i.e., the teeth number ratios, between the transmission members of the drive transmitting system shown in FIG. 3. Referring to FIGS. 4 and 5, numbers having a prefix "z" indicate the numbers of teeth of these transmission members.

FIG. 4 shows a case in which the teeth number ratios between the gear pulleys 51 and 52, the gear pulleys 59 and 55, and the gear pulleys 56 and 58 are set at integer multiple ratios such as 1:4, 1:2, and 1:7, respectively. In an experiment, the speed reducing specification shown in FIG. 4 was applied to a stepping motor equipped with a damper 50*d* (FIG. 3) for suppressing unnecessary vibrations. While the platen roller 10 was rotated by 8 pulses at a pitch of 300 dpi in the sub-scan direction, an ink layer of each of Y, M, and C was transferred (i.e., whenever the operation for one color was completed, the platen roller 10 was returned to the reference position, and the operation for the next color was started). As a consequence, the dot positional deviations between these colors were within ±5 $\mu$m, i.e., high positional accuracy was realized.

FIG. 5 shows a case in which the teeth number ratios between the gear pulleys 51 and 52, the gear pulleys 59 and 55, and the gear pulleys 56 and 58 are set at integer multiple ratios such as 1:3, 1:2, and 1:7, respectively. In an experiment, the speed reducing specification shown in FIG. 5 was applied to a stepping motor equipped with the damper 50*d* (FIG. 3) for suppressing unnecessary vibrations. While the platen roller 10 was rotated by 6 pulses at a pitch of 300 dpi in the sub-scan direction, an ink layer of each of Y, M, and C was transferred. Consequently, high positional accuracy was realized as in the case of FIG. 4.

An image forming method using the image forming apparatus shown in FIG. 1 will be described below with reference to FIGS. 12A to 12C.

First, information pertaining to the target body 1 and to an image to be formed is input to the controller C1. Also, the target body 1, the intermediate transfer medium 6, and the ink ribbon 7, each having the aforementioned structure, are set in predetermined positions of the image forming apparatus. Subsequently, with the intermediate transfer medium 6 and the ink ribbon 7 overlapped on the platen roller 10, the ink ribbon 7 is repeatedly selectively heated by the thermal head 38 under the control of the controller C1 on the basis of image information, thereby forming a record image on the intermediate transfer medium 6.

Figure 12A:
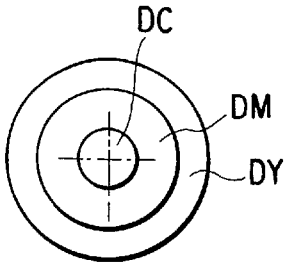
FIGS. 12A to 12C are schematic views for explaining an image forming method according to an embodiment of the present invention.
Figure 12B:
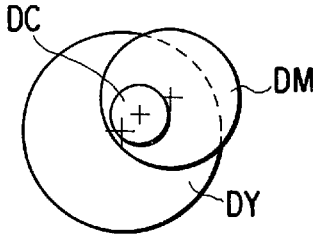
Figure 12C:
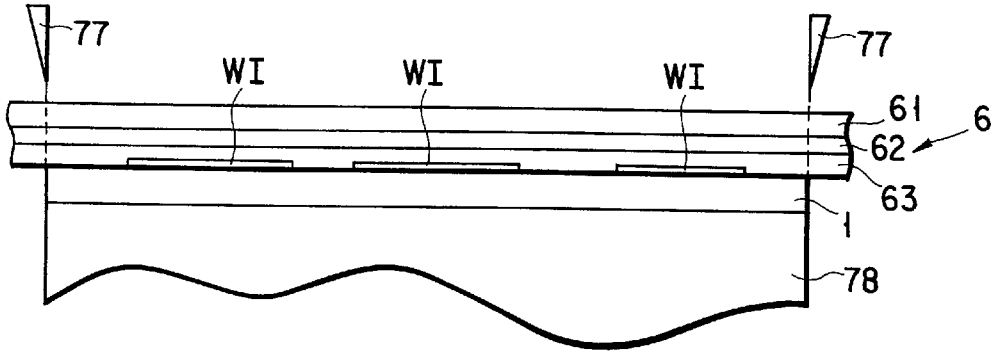

In this image forming process, for example, to form an area gradation image (e.g., a photograph of a person's face of a passport) of the record image, while the intermediate transfer medium 6 is fed by rotating the platen roller 10 counterclockwise in FIG. 1, the ink layer 72C is selectively transferred to form a dot DC of a cyan image of the record image (FIGS. 12A and 12B). Subsequently, the platen roller 10 is rotated clockwise in FIG. 1 to return the intermediate transfer medium 6 to the initial position. The platen roller 10 is then rotated counterclockwise in FIG. 1 to feed the intermediate transfer medium 6, and at the same time the ink layer 72M is selectively transferred to overlap a dot DM of a magenta image of the record image on the dot DC of the cyan image (FIGS. 12A and 12B). The platen roller 10 is again rotated clockwise in FIG. 1 to return the intermediate transfer medium 6 to the initial position. Subsequently, while the intermediate transfer medium 6 is fed by rotating the platen roller 10 counterclockwise in FIG. 1, the ink layer 72Y is selectively transferred to overlap a dot DY of a yellow image of the record image on the dot DM of the magenta image (FIGS. 12A and 12B).

After that, to form a binary image (e.g., characters and symbols of the passport) of the record image, the platen roller 10 is rotated clockwise in FIG. 1 to return the intermediate transfer medium 6 to a predetermined position for forming the binary image. The platen roller 10 is then rotated counterclockwise in FIG. 1 to feed the intermediate transfer medium 6, and at the same time the ink layer 72B is selectively transferred to form the binary image. In this manner, the record image containing the multicolor, area gradation image of the three colors Y, M, and C and the binary image of the color B is formed on the image-receiving layer 63 of the intermediate transfer medium 6.

The order of thermal transfer of a plurality of colors can be properly designed by considering the various characteristics (e.g., the transparency, hue, and transfer density) of ink layers used, the purpose of image quality design, or the various characteristics of the apparatus. Another image forming method is also preferred in which a binary image is first recorded by B (black) on an intermediate transfer medium and then a multicolor area gradation image having an area gradation by using the three colors in the order of C, M, and Y. In this method, an alignment mark for aligning an intermediate transfer medium with a target body by using photosensors 100 and 101 (FIG. 1) when the formed image is to be transferred onto the target body by heat and pressure by using the heat roller in the post-step can be formed using the first ink of B. This is convenient because B can be sensed more easily than the other colors.

If in one frame a region for forming an area gradation image and a region for forming a binary image are separated from each other or different in length, the start and end positions of thermal transfer of different colors need not be the same. For example, the positions of the three colors C, M, and Y are made equal to each other, whereas the position of B is made different from the other colors. That is, appropriate design can be made in accordance with the intended purpose.

FIG. 12A shows a case in which dots of the three colors are stacked with high positional accuracy. FIG. 12B shows a case in which these dots of the three colors are stacked with low positional accuracy. In either case, the sizes of the dots of the individual colors are determined on the basis of the halftone of an image to be expressed in that location, and these dots are formed by thermal transfer.

Subsequently, the intermediate transfer medium 6 on which the record image is formed and the target body 1 are overlapped between the heat roller 10 and the tray 2 and applied with heat and pressure, thereby transferring the record image from the intermediate transfer medium 6 onto the target body 1. When the layers on the substrate film 61 of the intermediate transfer medium 6 are so formed as to be collectively transferred by leaving the substrate film 61 behind, the heat-bonding layer 63 also serving as an image-receiving layer, the security image layer, the protective layer 62, and the like on the intermediate transfer medium 6 are collectively transferred as one image layer onto the target body 1. As shown in FIG. 12C, it is also possible to punch the intermediate transfer medium 6 along the contour of the target body 1 by using a punching means such as a combination of a cutter 77 and a die (a punching die) 78, thereby transferring a record image W1 along with the punched portion (portions of the film 61 and the layers 62 and 63) of the intermediate transfer medium 6 onto the target body 1. When this is the case, the substrate film 61 of the intermediate transfer medium 6 also functions as a protective layer.

A region on the target body 1 onto which an image formed on the intermediate transfer medium 6 is to be transferred can be, e.g., the entire surface, only a portion except for the edges of the surface, or only a portion primarily including an image portion on the surface of the target body 1. Also, as is often encountered in cards, it is possible to form a non-image-formation region (a region onto which no image is to be transferred) such as a signature panel on the surface of a card as a target body or a terminal portion of an IC card.

More specifically, to transfer an image onto a desired one of an image formation region and a non-image-formation region on the surface of a target body, it is basically only necessary to heat and press the image against the surface of the target body in the image formation region and not to heat and press the image against the surface of the target body in the non-image-formation region. When heating and pressing are performed using a heat roller, for example, this is possible by properly designing the dimensions (the width and diameter) of the heat roller or by appropriately roughening the surface of the heat roller.

In the above embodiment, the intermediate transfer medium 6 has, as an example, the structure in which the image-receiving layer 63 is an image-receiving layer/bonding layer having adhesion to the target body 1. In some cases, however, this image-receiving layer cannot achieve its adhesion to the target body because the affinity of the material of the image-receiving layer for the material of the target surface of the target body is low. In a case like this, an adhesive layer can be formed on the image-receiving layer in which an image is formed or on the target surface of the target body. This adhesive layer is formed by transferring the layer onto the surface or coating the surface with the adhesive. It is also possible to overlap the intermediate transfer medium and the target body and heat and press them with an adhesive sheet interposed between the image-receiving layer, in which an image is formed, and the target surface of the target body.

Figure 13:
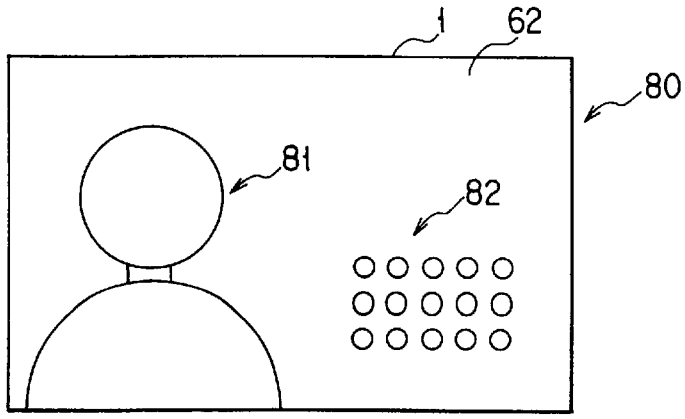
FIG. 13 is a plan view showing a certificate, e.g., a passport, as an image-applied article (a product) formed by the image forming apparatus according to the present invention.

FIG. 13 is a plan view showing a certificate, such as a passport, as an image-applied article (a product) formed by the image forming apparatus according to the present invention.

A certificate 80 includes a color image portion 81 formed by an area gradation image and a black-and-white image portion 82 formed by a binary image on a substrate as the target body 1. Dots of individual colors for forming these images have a thickness of 1 $\mu$m or less. The substrate and images are covered with a transparent resin layer derived from the protective layer 62 of the intermediate transfer medium 6. The color image portion 81 is, e.g., a photograph of a person's face. The black-and-white image portion 82 is, for example, a character/symbol portion including personal information. Representative examples of this personal information are the name, date of birth, position, and the like of a genuine owner. When this image-applied article is a certificate other than a passport, the personal information can further contain various code numbers, a symbol of information concerning a body part, e.g., a fingerprint, voiceprint, or retina, or a barcode, two-dimensional barcode, or some other pattern formed by converting one of these pieces of information by some means.

OCR characters or symbols to be mechanically read are preferably formed by a binary image using an ink of B so that they are suited to mechanical reading. As a representative example, binary images such as OCR characters and symbols defined by ICAO as an international standard for a passport are preferably formed using an ink of B.

The image forming apparatus according to the embodiment of the present invention can record general information and characters, numbers, symbols, seals, and patterns representing the personal information as very fine, sharp micro characters formed as portions of the recorded image. FIG. 14 is a view showing an example of micro characters 85 formed as a binary image by using sets of dots 84 which are formed by transferring the black ink layer 72B by using the thermal head 38.

That is, micro characters difficult to find because they are fine are desirably secretly hidden in a thermally transferred record image. If an image-applied article is forged, this forgery can be found if no such micro characters are formed. Also, even if such micro characters can be forged, the forgery requires many days, much labor, and high cost. Accordingly, the use of micro characters is effective to suppress or prevent forgery.

The location, contents, and number of micro characters can be appropriately changed. Especially when the personal information is used as the contents of micro characters, the effect of suppressing or preventing forgery is enhanced. Note that the dot pitch in the example shown in FIG. 14 is set at 300 dpi in both main scan and sub-scan directions D1 and D2. Note also that character smoothing is performed by changing the dot diameter in curved portions of each character.

FIG. 15 is a view showing finer micro characters 86 formed by sets of dots 84. The pitch of the dots 84 in this example shown in FIG. 15 is set at 300 dpi in the main scan direction D1 and at 1,200 dpi in the sub-scan direction D2. It is usually impossible to change the intervals between the heat-generating portions 38*a* of the thermal head 38 unless the thermal head 38 itself is replaced with one having different specifications. That is, it is unrealistic to appropriately change the dot pitch in the main scan direction. In the sub-scan direction, however, the dot pitch can be properly changed by changing the conveyance pitch of the intermediate transfer medium 6. Accordingly, it is possible to densely form dots and improve the character smoothing performance by changing the dot pitch in the sub-scan direction.

The image forming apparatus according to the embodiment of the present invention can also form a pattern for generating moire when a recorded image is read by a scanner, as a part of the recorded image. FIG. 16 is a view showing an example of a moire-generating pattern 87 formed as a binary image by using sets of dots 84 which are formed by transferring the black ink layer 72B by using the thermal head 38.

In this example shown in FIG. 16, the pitch of the dots 84 is set at 300 dpi in the main scan direction D1 and at 1,200 dpi in the sub-scan direction. By using high accuracy of dot formation positions, a pattern in which thin lines extend in a plurality of different oblique directions is formed. Consequently, in connection with the reading pitch of a scanner, moire is always generated in an image read by a scanner regardless of the reading position (or direction) of the scanner.

The moire-generating pattern 87 exists in a recorded image (a genuine product) formed by the present invention. The existence of this pattern 87 is generally unnoticed because there is no moire generated. However, when the image is copied using a scanner, e.g., when the image is copied by a copying apparatus using xerography, moire is generated in that portion of the copied product which corresponds to the pattern 87 on the genuine product.

By using this characteristic, it is desirable to secretly hide a moire-generating pattern difficult to find in part of a thermally transferred record image. If this image-applied article is forged through scanner reading and the generation of this moire is noticed, the image-applied article is found to be a forgery. This is effective to prevent illegal acts such as forgery. Note that this moire-generating pattern can also be formed into characters such as "VOID".

The resolution of a binary image according to the present invention is not limited to those of the examples shown in FIGS. 14 to 16 but is appropriately determined in accordance with the design of an apparatus or processing software. That is, the resolution can be designed to be higher than in the examples shown in FIGS. 14 to 16 in both the main scan and sub-scan directions. For example, it is possible to use 300, 600, 800, 900, 1,200, and 2,400 dpi or more as resolution.

In the above embodiment, a passport is used as an example of an image-applied article. However, the present invention is applicable to diverse image-applied article. That is, many image-applied article are required to have security from a market or social viewpoint. Therefore, it is desirable that these image-applied article be difficult to forge or allow easy finding of illegality even if they are forged. Examples of such image-applied article are booklets such as a bankbook and passport, stickers such as a visa pasted on a passport, and cards such as credit cards, cash cards, bank cards, debit cards, prepaid cards, point cards, various licenses, ID cards, employee IDs, student IDs, member's cards, magnetic cards, IC cards (e.g., contact type, non-contact type, composite type of contact type and non-contact type, composite type of contact type and optical type, and composite type of contact type and infrared type), and optical cards.

The present invention is applicable to any image-applied article other than the above image-applied article, as long as the image-applied article is required to have security. Also, the present invention is not restricted to the fields of image-applied article required to have security and of the relevant image formation but can be applied to other fields. However, the present invention becomes more valuable when applied to fields required to have security.

In the present invention, the heat-generating portion 38*a* of the thermal head 38 is substantially square or substantially circular. Hence, formed dots are also substantially circular, so a dot change by area gradation is a dot diameter change of a substantially true circle. This results in a very smooth gradation change by area gradation. In addition, an area gradation image can be readily distinguished from a conventional sublimating image. For example, this helps examine genuineness when the present invention is used in an ID printer for a passport.

Since the platen 10 is driven by the drive transmitting system using a synchronous reduction gear such as timing belts or gears, no slip of the drive transmitting system occurs. Also, since the speed reducing ratio of each reduction gear is an integer multiple, the ripple periods of the power transmission torque ripples of reduction gears are equal to each other and synchronized. Therefore, dot images of different colors can be beautifully overlapped. Hence, images can be formed without any screen, so images basically need not be converted into screen images. This significantly reduces the load on a CPU.

Since the platen 10 is a roller, images can be easily formed by conveyance, holding, and transfer of the intermediate transfer medium 6. This roller platen 10 particularly improves the adhesion between the intermediate transfer medium 6 and the platen 10. This helps accurately map each dot.

Since no recess (depression or the like) is present on the heating surface 38*b* of the heat-generating portion 38*a* of the thermal head 38, heat is conducted smoothly and directly from the heat-generating portion 38*a*. Especially when small-diameter dots (corresponding to a highlight portion of an image) are to be formed, it is important to conduct a slight heat amount to the ink ribbon 7 within a short time period and thermally melt only a small area of the ink layer 72 of the ink ribbon 7. Therefore, it is possible to form a highlight portion and well visualize a mixed color image containing this highlight image. This can implement high-quality area gradation (color mixture) from small dots to large dots and dot-on-dot by which different colors are overlapped.

The driving source of the platen 10 is the stepping motor 50 driven by the number of steps by which the speed reducing ratio with respect to a transmission member is an integer multiple. For example, one pitch of a dot in the sub-scan direction can be moved step-by-step by four steps or five steps, by which synchronization can be obtained, as the number of steps of the stepping motor 50. Accordingly, synchronization is obtained without any fine control, and this further improves the alignment accuracy of each color.

Since the damper 50*d* damps unnecessary vibrations of the stepping motor 50, the alignment accuracy of each color further increases. Also, when "stop printing" by which transfer is performed by stopping the operation between steps during printing is to be performed, unnecessary vibrations between the rotation and stop of the stepping motor or the like must be reduced within short time periods. Hence, the existence of the damper 50*d* is particularly important.

The platen roller 10 has a surface structure in which the elastic layer 10*a* is covered with the rigid layer 10*b*. This prevents the heat-generating portions 38*a* and their vicinities of the thermal head 38 from sinking into the ink ribbon 7 and achieves efficient heat conduction. Also, since the rigid surface layer 10*b* keeps the accuracy of the roller surface, different colors can be accurately matched.

If a holding member such as a so-called rubber member not having this rigid layer 10*b* on its surface is used, the heat-generating portions 38*a* and their vicinities of the thermal head 38 make inroads into the ink ribbon 7. Consequently, heat is radiated to portions other than locations where dots are to be originally formed, so no high-quality dots can be formed. Additionally, unnecessary elastic changes or temperature changes of the elastic layer made of, e.g., rubber make it difficult to hold the intermediate transfer medium 6 with high accuracy. As a consequence, accurate color alignment becomes difficult to perform.

Since the heat roller 40 presses and heats the intermediate transfer medium 6 and the target body 1, a record image can be easily transferred onto the target body 1. A high-quality image can be formed on the target body 1 by a relatively small heat amount at a low temperature. This is convenient from the viewpoint of apparatus design and also reduces the number of other components. Consequently, it is possible to miniaturize the image forming apparatus, simplify the mechanisms, and reduce the cost.

By the use of the punching means including the cutter 77 and the like, the intermediate transfer medium 6 can be punched along the contour of a target body 1 simultaneously with or after transfer of a record image. Accordingly, it is possible to transfer the record image along with the punched portion of the intermediate transfer medium 6 onto the target body 1, thereby forming a thick layer on the record image on the target body 1 at once. That is, when the protective layer 62 for protecting a thermally transferred record image is to be formed, high performance can be easily imparted to this protective layer 62.

Accordingly, in the image forming apparatus and method according to the embodiment of the present invention, the combined effect of improvements of the driving system for the holding member, such as the platen roller 10, for holding the intermediate transfer medium 6, and improvements of the thermal head 38 as a writing device makes it possible to form an area gradation image by dot-on-dot using substantially truly circular dots when the image is recorded on the intermediate transfer medium 6 by transfer.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which uses a thermal transfer ribbon having a plurality of ink layers of different colors containing a coloring material selected from the group consisting of a pigment and dye, and a long, film-like intermediate transfer medium capable of transferring said ink layers from said thermal transfer ribbon, comprising:

a platen for holding said intermediate transfer medium when said ink layers are transferred from said thermal transfer ribbon to said intermediate transfer medium;

a driving mechanism which comprises a driving source and transmission members and drives said platen, said transmission members being interposed between said driving source and said platen to mesh with each other and having a speed reducing ratio which is an integer multiple;

a thermal head which has a substantially regular polygonal or substantially circular heat-generating portion and selectively heats said thermal transfer ribbon while said intermediate transfer medium and said thermal transfer ribbon are overlapped on said platen, thereby selectively transferring said ink layers onto said intermediate transfer medium;

control means for forming a record image containing an area gradation image on said intermediate transfer medium by driving said thermal head, on the basis of image information, in collaboration with driving of said platen by said driving mechanism, said area gradation image being made up of sets of dots having different colors formed by said ink layers and having a color set by stacking said dots having different colors in substantially the same spot; and heating and pressing means for overlapping said intermediate transfer medium on which said record image is formed and a target body and applying heat and pressure to said intermediate transfer medium and said target body, thereby transferring said record image from said intermediate transfer medium onto said target body.

2. An image forming apparatus according to claim 1, wherein said intermediate transfer medium comprises an image-receiving layer, and said record image is formed on said image-receiving layer and transferred together with said image-receiving layer onto said target body.

3. An image forming apparatus according to claim 1, further comprising punching means for punching said intermediate transfer medium along the contour of said target body and transferring said record image together with the punched portion of said intermediate transfer medium onto said target body.

4. An image forming apparatus according to claim 1, wherein said record image further contains a binary image.

5. An image forming apparatus according to claim 1, wherein said driving source is a stepping motor driven by the number of steps by which a speed reducing ratio is an integer multiple with respect to said transmission members.

6. An image forming method which uses a thermal transfer ribbon having a plurality of ink layers of different colors containing a coloring material selected from the group consisting of a pigment and dye, and a long, film-like intermediate transfer medium capable of transferring said ink layers from said thermal transfer ribbon, comprising:

an image forming step of forming a record image containing an area gradation image on said intermediate transfer medium by repeating an operation of selectively heating said thermal transfer ribbon by a thermal head on the basis of image information while said intermediate transfer medium and said thermal transfer ribbon are overlapped on a platen, said area gradation image being made up of sets of dots having different colors formed by said ink layers and having a color set by stacking said dots having different colors in substantially the same spot, and a driving mechanism of said platen comprising a driving source and transmission members interposed between said driving source and said platen to mesh with each other and having a speed reducing ratio which is an integer multiple; and a heating and pressing step of overlapping said intermediate transfer medium on which said record image is formed and a target body and applying heat and pressure to said intermediate transfer medium and said target body, thereby transferring said record image from said intermediate transfer medium onto said target body.

7. An image forming method according to claim 6, wherein said intermediate transfer medium comprises an image-receiving layer, and said record image is formed on said image-receiving layer and transferred together with said image-receiving layer onto said target body.

8. An image forming method according to claim 6, further comprising the punching step of punching said intermediate transfer medium along the contour of said target body and transferring said record image together with the punched portion of said intermediate transfer medium onto said target body.

9. An image forming method according to claim 6, wherein said record image further contains a binary image.

10. An image forming method according to claim 9, wherein the image forming step comprises a step of forming, as said binary image, micro characters made up of elements selected from the group consisting of characters, numbers, symbols, seals, and patterns, by using sets of said dots.

11. An image forming method according to claim 9, wherein the image forming step comprises a step of forming, as said binary image, a pattern for generating moire when said record image is read by a scanner, by using sets of said dots.

12. An image-applied article comprising a substrate, a record image, and a transparent resin layer formed on said substrate to cover said record image such that said record image is visible, wherein said record image contains an area gradation image and binary image, said area gradation image is made up of sets of dots having different colors formed by ink layers and has a color set by stacking said dots having different colors in substantially the same spot, said binary image comprises micro characters formed by using sets of said dots and made up of elements selected from the group made up of characters, numbers, symbols, seals, and patterns.

13. An image-applied article according to claim 12, wherein said micro characters represent personal information pertaining to a main part of said record image.

14. An image-applied article comprising a substrate, a record image, and a transparent resin layer formed on said substrate to cover said record image such that said record image is visible, wherein said record image contains an area gradation image and binary image, said area gradation image is made up of sets of dots having different colors formed by ink layers and has a color set by stacking said dots having different colors in substantially the same spot, said binary image comprises a pattern formed by using sets of said dots to generate moire when said record image is read by a scanner.

15. An image-applied article according to claim 14, wherein said pattern for generating moire is formed such that thin lines extend in a plurality of different oblique directions by dots formed at a high-resolution pitch.

* * * * *